US006234160B1

(12) United States Patent
Nagatsuka et al.

(10) Patent No.: US 6,234,160 B1
(45) Date of Patent: May 22, 2001

(54) ABNORMALITY TRANSMISSION SYSTEM FOR WIRE SAW

(75) Inventors: Shinji Nagatsuka; Hiroo Unozawa, both of Mitaka; Hiroshi Oishi, Annaka; Keiichiro Asakawa, Annaka; Junichi Matsuzaki, Annaka, all of (JP)

(73) Assignees: Tokyo Seimitsu Co., Ltd., Mitaka; Super Silicon Crystal Research Institute Corp., Annaka, both of (JP)

( * ) Notice: Subject to any disclaimer, the term of this patent is extended or adjusted under 35 U.S.C. 154(b) by 0 days.

(21) Appl. No.: 09/492,837

(22) Filed: Jan. 27, 2000

(30) Foreign Application Priority Data

Jan. 28, 1999 (JP) ..... 11-019568

(51) Int. Cl.[7] ..... B28D 1/06
(52) U.S. Cl. ..... 125/16.02; 125/21
(58) Field of Search ..... 125/16.01, 16.02, 125/21; 379/37, 39, 40, 41, 51

(56) References Cited

FOREIGN PATENT DOCUMENTS

| | | |
|---|---|---|
| 1-173199 | 7/1989 | (JP) . |
| 5-247745 | 9/1993 | (JP) . |
| 6-170717 | 6/1994 | (JP) . |
| 9-282027 | 10/1997 | (JP) . |
| 10-308737 | 11/1998 | (JP) . |
| 11-16072 | 1/1999 | (JP) . |

*Primary Examiner*—Timothy V. Eley
*Assistant Examiner*—Dung Van Nguyen
(74) *Attorney, Agent, or Firm*—Nixon Peabody LLP; David S. Safran

(57) ABSTRACT

If something goes wrong with a wire saw, a personal computer outputs a dial signal to a modem, which dials a calling number of a pager carried by an operator through a telephone system. The sound of the pager notifies the operator of the abnormality of the wire saw even if he or she is not in the vicinity of the wire saw.

4 Claims, 2 Drawing Sheets

ABNORMALITY TRANSMISSION SYSTEM FOR WIRE SAW

BACKGROUND OF THE INVENTION

1. Field of the Invention

The present invention relates generally to an abnormality transmission system for a wire saw, and more particularly to an abnormality transmission system for a wire saw that slices hard and brittle materials such as silicon, glass and ceramics.

2. Description of Related Art

If something goes wrong with a wire saw, there is the necessity of solving the problem in order to prevent the waste of an expensive ingot such as silicon. A conventional wire saw informs an operator of the abnormality by turning on a warning light provided on the body of the wire saw or sounding a buzzer or a siren.

In this case, however, the operator must be near the wire saw at all times, and this imposes a heavy responsibility on the operator. Particularly since the diameter of the ingot has been increasing in recent years, it takes a long time to slice one ingot (e.g., it takes about 26 hours to slice an ingot with the diameter of 450 mm). It is often difficult for the operator to be near the wire saw at all times during the slicing.

SUMMARY OF THE INVENTION

It is therefore an object of the present invention to provide an abnormality transmission system for a wire saw, which enables an operator to be informed of an abnormality of the wire saw even if the operator is not in the vicinity of the wire saw.

This invention can be achieved by providing an abnormality transmission system for a wire saw which presses a workpiece against a running wire row to thereby slice said workpiece into a number of wafers, said abnormality transmission system comprising: mobile communication equipment such as a pager and a cellular phone carried by an operator; monitoring means for monitoring the working conditions of said wire saw; abnormality detecting means for detecting an abnormality of said wire saw in accordance with the monitoring results of said monitor means; and dial means for dialing a calling number of said mobile communication equipment through a telephone system if said abnormality detecting means detects the abnormality of said wire saw.

According to the present invention, if something goes wrong with the wire saw, the abnormality is transmitted to the mobile communication equipment such as the pager and the cellular phone carried by the operator. Therefore, the operator can be informed of the abnormality of the wire saw even if he or she is not in the vicinity of the wire saw.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

First, a description will be given of the structure of a wire saw, to which an abnormality transmission system of the present invention is applied.

Figure 1:
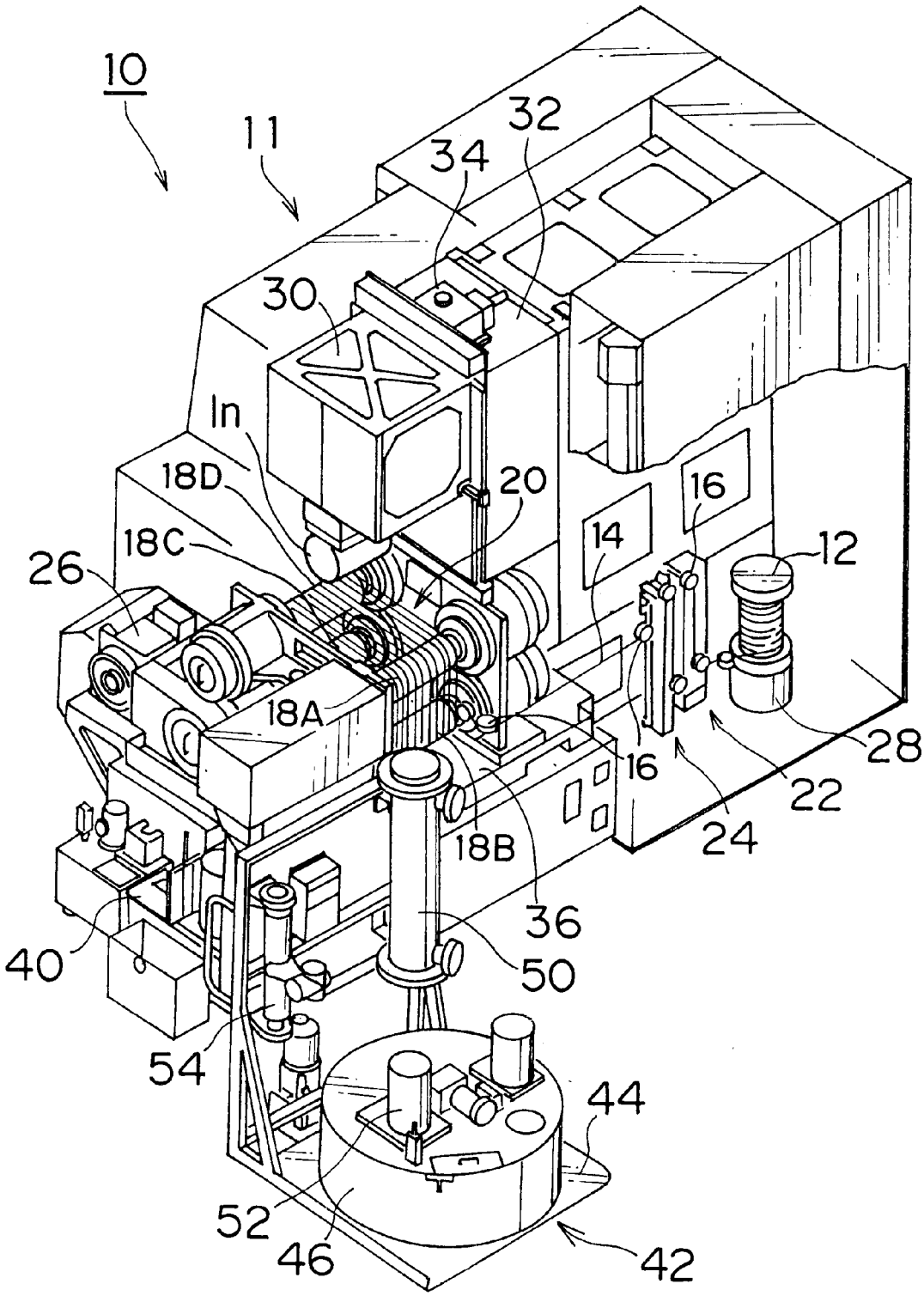
FIG. 1 is a perspective view showing the entire structure of a wire saw.

FIG. 1 is a perspective view showing the entire structure of a wire saw 10. As shown in FIG. 1, the wire saw 10 is comprised mainly of a body 11 for slicing and a slurry supply unit 42 for supplying a slurry to a slicing part of the body 11.

The body 11 of the wire saw 10 has a pair of wire reels 12 (FIG. 1 illustrates only one wire reel 12). The wire 14 is supplied from one wire reel 12 and is wound on four grooved rollers 18A, 18B, 18C, 18D with a constant intervals via one wire running passage composed of a number of guide rollers 16 to thereby form a horizontal wire row 20. Then, the wire 14 is wound around the other wire reel 12 (not illustrated) via the other wire running passage, which has the same structure as the one wire running passage. The wire running passages are formed symmetrically with respect to the wire row 20.

The wire running passages formed at both sides of the wire row 20 are respectively provided with a traverser 22 and a dancer roller unit 24 (only one wire running passage is illustrated). One traverser 22 winds the wire 14 around the wire reel 12 or feeds the wire 14 from the wire reel 12 at a constant speed. One dancer roller unit 24 winds the wire 14 on a dancer roller, which is supported with a deadweight in such a manner as to freely move vertically, to apply a constant tension to the wire 14.

The grooved roller 18C and the pair of wire reels 12 connect to motors 26, 28, respectively, which are rotatable forward and backward. Running the motors 26, 28 runs the wire 14 at a high speed to run the wire row 20 at a high speed.

A workpiece feed table 30 is arranged above the wire row 20. The workpiece feed table 30 is slidably provided to a perpendicular feed base 32. Running a workpiece feed motor 34 of the feed base 32 moves the workpiece feed table 30 vertically with respect to the wire row 20. An ingot In (not illustrated) to be machined, whose crystal axis is oriented in a predetermined direction, is held at the bottom of the workpiece feed table 30.

An oil pan 36 is placed below the wire row 20, and the oil pan 36 collects the slurry supplied to the wire row 20. One end of a collecting pipe (not illustrated) connects to the oil pan 36. The other end of the collecting pipe connects to a slurry collecting tank 40, and the slurry collected in the oil pan 36 is stored in the slurry collecting tank 40 through the collecting pipe.

A slurry supply unit 42 is constructed in such a manner that the slurry tank 46, a heat exchanger 50, a supply pump 52, a flowmeter 54 and so on are mounted on a movable cart 44.

The slurry tank 46 connects to one end of a tube (not illustrated), and the other end of the tube is detachably connected to the slurry collecting tank 40 through a collecting pump (not illustrated). The collecting pump raises the slurry stored in the slurry collecting tank 40 to feed the slurry to the slurry tank 46.

The supply pump 52 provided on the slurry tank 46 raises the slurry collected in the slurry tank 46 to feed the slurry to a slurry nozzle (not illustrated), from which the slurry is jetted to the wire row 20. The slurry jetted from the slurry nozzle is used for the machining, and then is collected in the oil pan 36 as described above. The slurry is returned to the slurry tank 46 through the slurry collecting tank 40. The slurry is circulated in this manner.

The slurry stored in the slurry tank 46 is circulated to the heat exchanger 50, which maintains the slurry at a constant temperature.

The wire saw 10 that is constructed in the above-mentioned manner slices the ingot In as follows. First, the ingot In is mounted at the workpiece feed table 30. Then, the motors26, 28 are run synchronously to reciprocate the wire 14 at the high speed in order to run the wire row 20 at the high speed. Then, the workpiece feed table 30 is lowered toward the wire row 20. At the same time, the supply pump 52 is run to jet the slurry from the slurry nozzle (not illustrated) to the wire row 20. Consequently, the ingot In is pressed against the wire row 20 running at the high speed, and is sliced into a number of wafers by the lapping operation of the slurry supplied to the wire row 20.

A description will now be given of the structure of the abnormality transmission system according to this embodiment. A control unit (not illustrated) controls the working conditions of the above-mentioned wire saw 10, and if something goes wrong with the wire saw 10, the control unit dials a calling number of a pager carried by the operator.

The control unit controls the working conditions of the wire saw 10; e.g., a wire running speed, a wire tension, whether the wire has broken or strayed, a workpiece feed speed, the temperature of slurry and the flow of the slurry. The operator enters a target value and an allowable value for each item. The control unit (monitoring means) judges that the wire saw 10 is working abnormally if the allowable value is exceeded.

Figure 2:
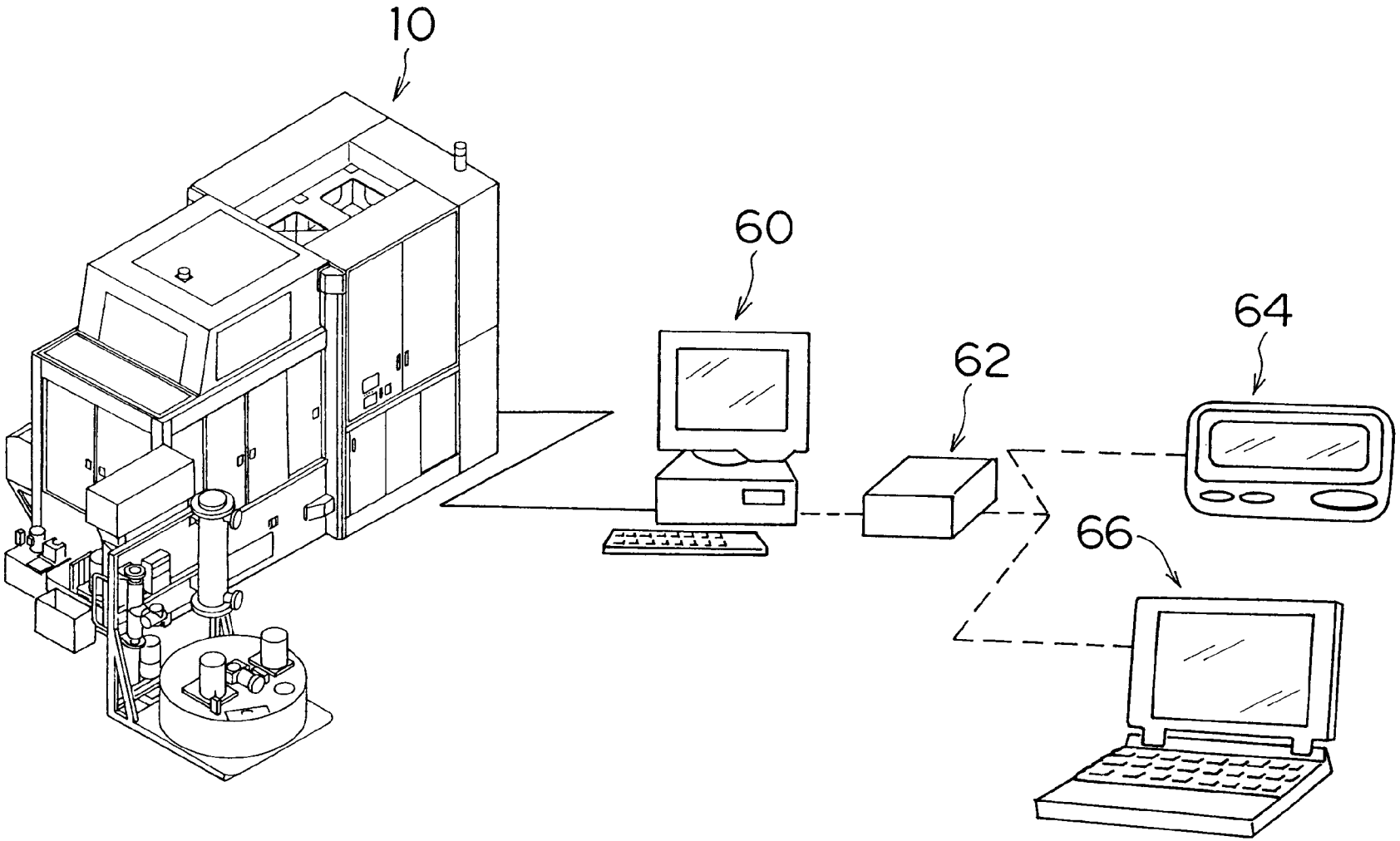
FIG. 2 is a view showing the structure of an abnormality transmission system for the wire saw.

As shown in FIG. 2, when the control unit judges that the wire saw 10 is working abnormally, the control unit outputs a dial command to a personal computer (PC) 60 connected to the wire saw 10. In response to the command, the PC 60 outputs a dial signal to a modem 62, which dials the calling number of the pager 64 through a telephone system.

A description will now be given of the operation of the abnormality transmission system according to this embodiment.

Before starting the operation of the wire saw 10, the operator inputs the target values and the allowable values with respect to the wire running speed, the wire tension, the workpiece feed speed, the temperature of the slurry and the flow of the slurry, and the like to the control unit. The operator also inputs the calling number of the pager 64 to the PC 60.

When the wire saw 10 starts running, the control unit monitors the working conditions of the wire saw 10 at all times. If the operator moves away from the wire saw 10, he or she carries the pager 64.

If the wire saw 10 goes wrong when the operator is not in the vicinity of the wire saw 10, the control unit outputs the dial command to the PC 60. In response to the command, the PC 60 outputs the dial signal to the modem 62, which dials the calling number of the pager 64 carried by the operator through the telephone system. Consequently, the pager 64 rings so that he or she can be informed of the abnormality of the wire saw 10.

Thus, the abnormality transmission system of the wire saw according to this embodiment eliminates the need for the operator to monitor the working conditions of the wire saw 10 at all times near the wire saw 10, and this reduces the responsibility on the operator. This system is effective particularly for a recent ingot with a large diameter because it takes a long time to slice such ingot.

A description will now be given of the second embodiment of the abnormality transmission system for the wire saw according to this invention.

In the first embodiment, the operator is informed of the abnormality of the wire saw 10 from the ring of the pager 64, but it is impossible for the operator to be informed of what is the problem with the wire saw 10.

The abnormality transmission system of the second embodiment informs the operator not in the vicinity of the wire saw 10 of the problem as follows.

Recently, the pager 64 has a display and is able to transmit a message. The problem with the wire saw 10 is transmitted to the operator by the message transmission function.

If the control unit detects an abnormality of the wire saw 10, it outputs the problem (e.g., "slurry temperature is abnormal" and "wire has strayed") as well as the dial command to the PC 60. In response to the command, the PC 60 outputs a message signal corresponding to the problem as well as the dial signal to the modem 62. The modem 62 dials the calling number of the pager 64 through the telephone system to transmit a number corresponding to the message. Consequently, the pager 64 carried by the operator rings and the message (i.e., "slurry temperature is abnormal" and "wire has strayed") is displayed on the display. With reference to the display, the operator is informed of the problem with the wire saw 10.

Thus, the abnormality transmission system of the second embodiment enables the operator to be informed of the abnormality of the wire saw 10 and the problem immediately even if he or she is not in the vicinity of the wire saw 10. Consequently, the operator, who is not in the vicinity of the wire saw 10, can determine whether the problem must be solved immediately or the wire saw 10 can be operated continuously for a while. This reduces the responsibility on the operator.

A description will now be given of the third embodiment of the abnormality transmission system for the wire saw according to the present invention.

In the second embodiment, the problem with the wire saw 10 is transmitted to the operator by using the message transmission function of the pager 64. In the third embodiment, the problem with the wire saw 10 is transmitted to the operator in a different manner.

Problems are previously coded, and if a problem occurs, the code corresponding to the problem is shown on the display of the pager 64. The operator recognizes the problem with reference to a list showing the codes and the corresponding problems. The operator carries this list with the pager 64. The system of the third embodiment will now be described in further detail.

When the control unit detects an abnormality of the wire saw 10, it outputs the problem (e.g., "slurry temperature is abnormal" and "wire has strayed") as well as the dial command to the PC 60. In response to the command, the PC 60 outputs a code signal corresponding to the problem as well as the dial signal to the modem 62. The codes corresponding to the problems are previously inputted to the PC 60 (e.g., "1" for "slurry temperature is abnormal", and "2" for "wire has strayed"). The code is outputted to the modem 62.

The modem 62 dials the calling number of the pager 64 carried by the operator through the telephone system, and transmits the code number. Consequently, the pager 64 carried by the operator rings, and the code number corresponding to the problem is shown on the display. The operator is informed of the problem with the wire saw 10 with reference to the code number shown on the display and the list of the code numbers carried by the operator.

Thus, the abnormal transmission system of the third embodiment enables the operator to be informed of the problem of the wire saw 10 if he or she is not in the vicinity of the wire saw 10. This reduces the responsibility on the operator.

A description will now be given of the fourth embodiment of the abnormality transmission system for the wire saw according to the present invention.

In the second and third embodiments, the problem of the wire saw 10 is transmitted to the operator by using the message transmission function of the pager 64. In the fourth embodiment, the problem of the wire saw 10 is transmitted to the operator by an electronic mail.

If something goes wrong with the wire saw 10, the pager carried by the operator rings to warn the operator of the abnormality. The detailed problem is transmitted to the operator by the electronic mail. The system of the fourth embodiment will now be described in further detail.

When the control unit detects an abnormality of the wire saw, it outputs the dial command to the PC 60. In response to the command, the PC 60 outputs the dial signal to the modem 62, which dials the calling number of the pager 64 carried by the operator through the telephone system. Consequently, the pager 64 carried by the operator rings so that the operator can be informed of the abnormality of the wire saw 10.

The control unit outputs the problem with the wire saw 10 as well as the dial command to the PC 60. The PC 60 transmits the problem with the wire saw 10 as the electronic mail. The operator, who has been informed of the abnormality of the wire saw 10, receives the electronic mail with a note-type PC 66 or the like to be informed of the problem.

Thus, the abnormality transmission system of the fourth embodiment enables the operator to be informed of the problems of the wire saw 10 if he or she is not in the vicinity of the wire saw 10. This reduces the responsibility on the operator. In the case of the electronic mail, there is no limitation to the number of transmissible characters and the like, so that the detailed problem can be transmitted to operator.

In the above-described embodiments, the pager 64 is used as a receiving means carried by the operator, but a cellular phone or the like provided with the message transmission function may also be used.

As set forth hereinabove, the abnormality transmission system of the present invention enables the operator to be informed of the abnormality of the wire saw immediately even if he or she is not in the vicinity of the wire saw. Therefore, the operator does not have to monitor the working conditions of the wire saw at all times near the wire saw. This reduces the responsibility on the operator.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An abnormality transmission system for a wire saw which presses a workpiece against a running wire row to thereby slice said workpiece into a number of wafers, said abnormality transmission system comprising:

mobile communication equipment having a calling number;

monitoring means for monitoring working conditions of said wire saw;

abnormality detecting means for detecting an abnormality of said wire saw in accordance with monitoring results of said monitor means; and dial means for dialing the calling number of said mobile communication equipment through a telephone system if said abnormality detecting means detects the abnormality of said wire saw.

2. The abnormality transmission system for the wire saw as defined in claim 1, wherein said mobile communication equipment has a message displaying function, and said dial means transmits a message of what is the problem with said wire saw after the dialing.

3. The abnormality transmission system for the wire saw as defined in claim 2, wherein problems of said wire saw are coded, and said dial means transmits a code corresponding to the problem of said wire saw as said message after the dialing.

4. An abnormality transmission system for a wire saw which presses a workpiece against a running wire row to thereby slice said workpiece into a number of wafers, said abnormality transmission system comprising:

monitoring means for monitoring working conditions of said wire saw;

abnormality detecting means for detecting an abnormality of said wire saw in accordance with the monitoring results of said monitor means; and transmission means for transmitting an electronic mail indicating what is a problem with said wire saw to a predetermined electronic mail address if said abnormality detecting means detects the abnormality of said wire saw.

* * * * *